US008777635B1

(12) United States Patent
Long et al.

(10) Patent No.: US 8,777,635 B1
(45) Date of Patent: Jul. 15, 2014

(54) DAUGHTER CARD ASSEMBLY HAVING A POWER CONTACT

(71) Applicant: Tyco Electronics Corporation, Berwyn, PA (US)

(72) Inventors: Brian Richard Long, York, PA (US); Michael David Herring, Apex, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/724,501

(22) Filed: Dec. 21, 2012

(51) Int. Cl.
*H01R 12/00* (2006.01)

(52) U.S. Cl.
USPC ..... 439/60; 439/633; 439/951

(58) Field of Classification Search
CPC ..... H01R 13/635; H01R 13/633
USPC ..... 439/159, 160, 155, 327, 329, 639, 630, 439/60, 633, 951
See application file for complete search history.

(56) References Cited

U.S. PATENT DOCUMENTS

| | | | | |
|---|---|---|---|---|
| 3,634,816 | A * | 1/1972 | Zell | 439/633 |
| 3,973,817 | A * | 8/1976 | Stalley et al. | 439/60 |
| 4,439,809 | A * | 3/1984 | Weight et al. | 361/220 |
| 4,864,458 | A * | 9/1989 | Demorat | 361/212 |
| 5,024,609 | A | 6/1991 | Piorunneck | |
| 5,336,117 | A | 8/1994 | Mizuguchi et al. | |
| 5,690,499 | A * | 11/1997 | Howell et al. | 439/157 |
| 5,943,218 | A * | 8/1999 | Liu | 361/801 |
| 6,135,781 | A * | 10/2000 | Pope et al. | 439/59 |
| 6,780,018 | B1 | 8/2004 | Shipe | |
| 7,744,376 | B2 | 6/2010 | Vrenna et al. | |
| 8,007,303 | B2 * | 8/2011 | Yao et al. | 439/327 |
| 8,157,576 | B2 * | 4/2012 | Fu et al. | 439/153 |
| 2011/0065297 | A1 * | 3/2011 | Guan et al. | 439/155 |
| 2011/0300759 | A1 | 12/2011 | Ngo | |
| 2012/0108092 | A1 * | 5/2012 | Li et al. | 439/159 |
| 2012/0164859 | A1 * | 6/2012 | Li et al. | 439/153 |
| 2012/0244734 | A1 * | 9/2012 | Fu et al. | 439/327 |

OTHER PUBLICATIONS

PCT International Search report issued in related application PCT/US2013/074624, mailed on Mar. 18, 2014.

* cited by examiner

*Primary Examiner* — Neil Abrams
*Assistant Examiner* — Phuongchi T Nguyen

(57) ABSTRACT

A daughter card assembly including a daughter card having a leading edge. The daughter card includes signal contacts that are disposed along the leading edge, wherein the leading edge is configured to be inserted into a card cavity of a receptacle connector during a mating operation. The daughter card assembly also includes a power module that is coupled to the daughter card. The power module includes a module housing having a module cavity and a cavity opening that provides access to the module cavity. The power module also includes a power contact that is disposed within the module cavity and projects through the cavity opening. The power contact is configured to engage a corresponding electrical contact of the receptacle connector during the mating operation. The power contact is deflected by the electrical contact into the module cavity as the power contact and the electrical contact engage each other.

20 Claims, 6 Drawing Sheets

DAUGHTER CARD ASSEMBLY HAVING A POWER CONTACT

BACKGROUND

The subject matter described and/or illustrated in the present application relates generally to a daughter card assembly configured to mate with a receptacle connector.

Computers, servers, and switches can use numerous types of daughter card assemblies, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), Dual In-line Memory Modules (DIMM's), Small Outline DIMM's (SODIMM's), Fully Buffered DIMM's, and the like. The daughter card assemblies may be installed in receptacle connectors that are mounted on a motherboard or other system board.

At least one known daughter card assembly includes a printed circuit board (PCB) having a leading edge and contact pads that are distributed along the leading edge on both sides of the PCB. The leading edge of the PCB is configured to be received within a slot of a receptacle connector. The receptacle connector includes opposing rows of electrical contacts that engage corresponding contact pads of the leading edge when the leading edge is inserted into the slot. The electrical contacts may be resilient contact beams that are normally in a relaxed or unbiased position. When the leading edge of the daughter card assembly is inserted into the card slot, the contact pads on both sides of the leading edge engage the corresponding contact beams. The contact beams are partially deflected and provide a resilient force against the corresponding contact pad to maintain the electrical connection.

However, the contact pads of the daughter card assembly and the electrical contacts of the receptacle connector are typically dimensioned for transmitting data signals. Although electrical power may also be transmitted through the electrical contacts and contact pads, the amount of power is limited due to the size of the electrical contacts and contact pads. In addition to limited power transmission, the daughter card assemblies and receptacle connectors are typically configured to satisfy a standard format or arrangement of the electrical contacts and contact pads. It may be difficult to incorporate power contacts into the daughter card assemblies and receptacle connectors without changing this standard format.

Accordingly, there is a need for a daughter card assembly and a receptacle connector that are configured to transmit electrical power in greater amounts than the amounts currently permitted.

BRIEF DESCRIPTION

In one embodiment, a daughter card assembly is provided that includes a daughter card having a leading edge extending along a longitudinal axis. The daughter card includes signal contacts that are disposed along the leading edge, wherein the leading edge is configured to be inserted into a card cavity of a receptacle connector during a mating operation when the leading edge is moved in an insertion direction that is substantially perpendicular to the longitudinal axis. The daughter card assembly also includes a power module that is coupled to the daughter card proximate to the leading edge. The power module includes a module housing having a module cavity and a cavity opening that provides access to the module cavity. The power module also includes a power contact that is disposed within the module cavity and projects through the cavity opening. The power contact is configured to engage a corresponding electrical contact of the receptacle connector during the mating operation. The power contact is deflected by the electrical contact into the module cavity as the power contact and the electrical contact engage each other.

In another embodiment, a receptacle connector is provided that includes a connector housing having opposite mating and loading faces and a mating axis extending therebetween. The connector housing has a card cavity that is accessed through the mating face and an interior wall that extends along the mating axis defining the card cavity. The connector housing and the card cavity extend lengthwise along a longitudinal axis that is perpendicular to the mating axis. The receptacle connector also includes signal contacts that are arranged along the interior wall and are exposed to the card cavity. The receptacle connector also includes a power contact disposed within the card cavity. The signal contacts and the power contact have different cross-sectional dimensions. The power contact and the signal contacts have respective wipe surfaces that engage corresponding electrical contacts of a daughter card during a mating operation. The daughter card coinciding with a central card plane when the daughter card and the receptacle connector are mated. The wipe surface of the power contact is a first center distance away from the card plane. The wipe surfaces of the signal contacts are a second center distance away from the card plane. The first center distance is greater than the second center distance.

Optionally, the interior wall is a first interior wall and the connector housing includes a second interior wall that faces the first interior wall. The card cavity may be defined between the first and second interior walls and include a signal region and a power region. The signal and power regions may have different spatial dimensions such that the signal region is dimensioned to receive a leading edge of the daughter card and the power region is dimensioned to receive the leading edge of the daughter card and a module housing that is mounted to the daughter card proximate to the leading edge.

In another embodiment, a communication system is provided that includes a receptacle connector having a connector housing with opposite mating and loading faces and a mating axis extending therebetween. The connector housing has a card cavity that is accessed through the mating face. The receptacle connector includes signal contacts and a power contact disposed within the card cavity. The communication system also includes a daughter card assembly that is configured to mate with the receptacle connector. The daughter card assembly includes a daughter card having a leading edge extending along a longitudinal axis. The daughter card includes first electrical contacts that are disposed along the leading edge. The daughter card assembly also includes a power module that is coupled to the daughter card proximate to the leading edge. The power module includes a module housing having a module cavity and a cavity opening that provides access to the module cavity. The power module also includes a second electrical contact that is disposed within the module cavity and projects through the cavity opening. The signal contacts of the receptacle connector engage the first electrical contacts of the daughter card during a mating operation. The power contact of the receptacle connector engages the second electrical contact of the daughter card during the mating operation. The second electrical contact is deflected toward the daughter card by the power contact as the second electrical contact and the power contact engage each other.

DETAILED DESCRIPTION

Embodiments described herein include daughter card assemblies, receptacle connectors, and communication systems that include the same. The daughter card assemblies and the receptacle connectors may include signal contacts that are configured for transmitting data signals as well as one or more power contacts that are configured for transmitting electrical power. Daughter card assemblies include printed circuit boards (PCBs) (also referred to as daughter cards) and may include one or more power modules having the power contacts. The receptacle connectors may be configured to receive the power modules.

In some embodiments, the receptacle connectors are configured to mate with more than one type of daughter card assembly. For instance, the receptacle connectors may be configured to receive a daughter card assembly that has a power contact and/or power module as described herein or, alternatively, configured to receive an industry standard (or conventional) daughter card assembly that does not include such power contacts or power modules. The daughter card assemblies described herein as well as the conventional daughter card assemblies that may be inserted into the receptacle connectors described herein may include processor and memory modules. By way of example only, such daughter card assemblies may include Dynamic Random Access Memory (DRAM), Synchronous Dynamic Random Access Memory (SDRAM), or Extended Data Out Random Access Memory (EDO RAM), and the like. The daughter card assemblies may be produced in a number of formats such as, for example, Single In-line Memory Modules (SIMM's), Dual In-line Memory Modules (DIMM's), Small Outline DIMM's (SODIMM's), Fully Buffered DIMM's, and the like. The daughter card assemblies and receptacle connectors described herein may be used in, for example, computing systems, servers, switches, and the like.

Figure 1:
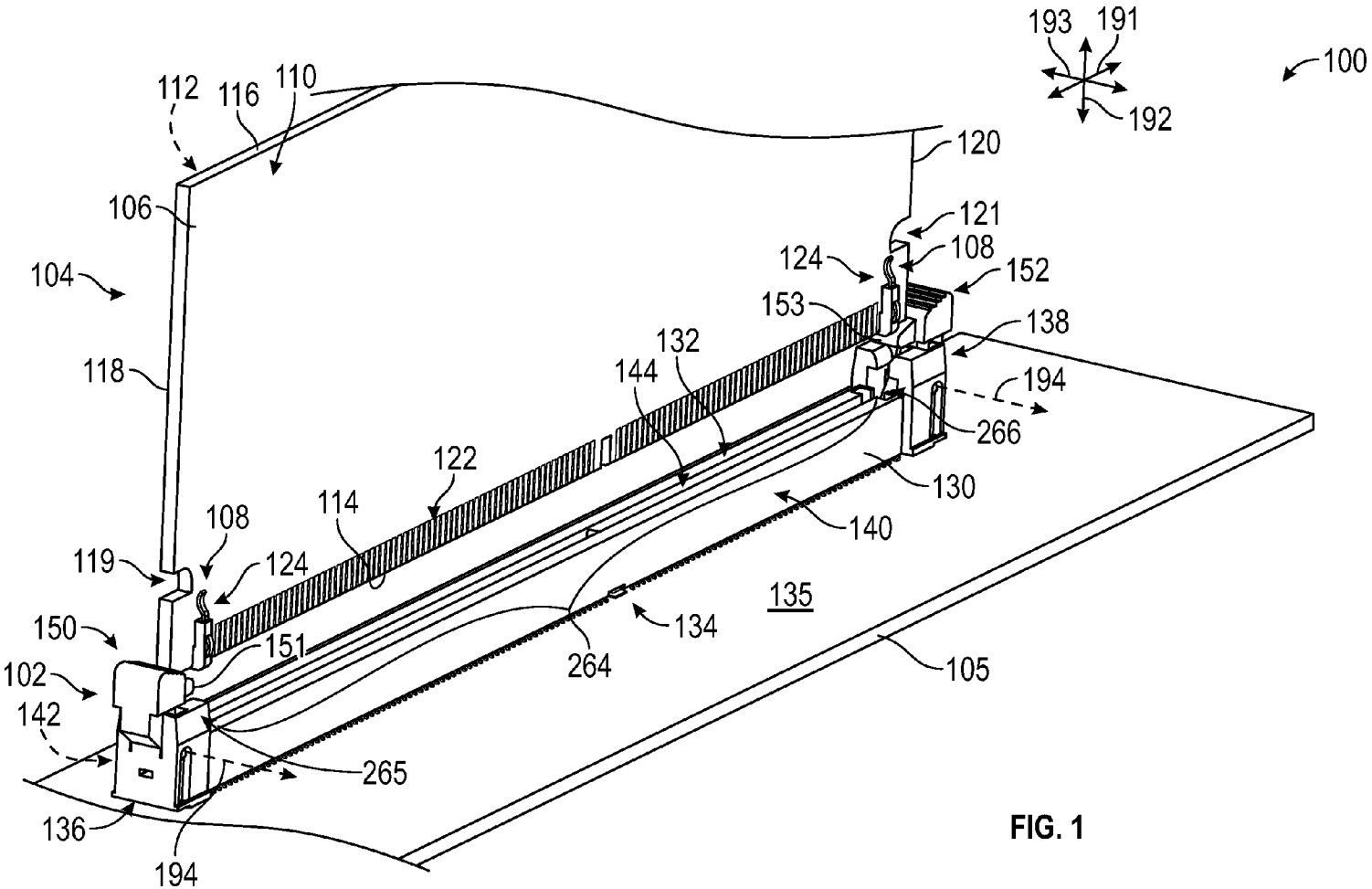
FIG. 1 is a perspective view of a communication system that includes a receptacle connector and a daughter card assembly formed in accordance with one embodiment.

FIG. 1 is a perspective view of a communication system 100 in accordance with one embodiment that includes a receptacle connector 102 and a daughter card assembly 104 that are configured to engage each other during a mating operation. The receptacle connector 102 may be mounted to a PCB 105 (e.g., a motherboard). The communication system 100 in FIG. 1 is oriented with respect to mutually perpendicular axes 191-193, including a longitudinal axis 191, a mating axis 192, and a lateral axis 193. As shown, the daughter card assembly 104 includes a daughter card 106, which may also be a PCB. The daughter card assembly 104 may include one or more power modules 108 that are coupled (e.g., mounted) to the daughter card 106. In the illustrated embodiment, the daughter card assembly 104 has two power modules 108. In alternative embodiments, however, only one power module may be used or more than two power modules may be used. Although not shown in FIG. 1, the daughter card assembly 104 may also include memory modules or processor modules that are mounted to the daughter card 106.

The daughter card 106 has a planar body with opposite side surfaces 110, 112. The daughter card 106 is defined by a plurality of card or board edges that include a leading edge 114, a trailing edge 116, and interconnecting edges 118, 120 that extend between the leading and trailing edges 114, 116. The interconnecting edges 118, 120 may include latch notches 119, 121. The leading edge 114 extends lengthwise along the longitudinal axis 191 and includes electrical contacts 122 and 124 distributed therealong on the side surface 110. Although not shown, the electrical contacts 122, 124 may also be distributed along the side surface 112. The electrical contacts 122 are dimensioned to transmit data signals and, as such, are hereinafter referred to as signal contacts 122. In some embodiments, the signal contacts 122 are contact pads that may be, for example, etched onto the side surface 110. In the illustrated embodiment, the electrical contacts 124 are part of the power modules 108 and are dimensioned to transmit electrical power. Hereinafter, the electrical contacts 124 are referred to as power contacts 124. The power contacts 124 may be stamped and formed from conductive sheet material (e.g., metal).

The receptacle connector 102 includes a connector housing 130 having a mating face 132 and a loading face 134. The mating axis 192 may extend between the mating and loading faces 132, 134. The loading face 134 is configured to be mounted onto a board surface 135 of the PCB 105. As shown in FIG. 1, the connector housing 130 extends lengthwise along the longitudinal axis 191 between opposite housing ends 136, 138. The connector housing 130 also includes housing sides 140, 142. The housing sides 140, 142 and the mating and loading faces 132, 134 extend between the housing ends 136, 138.

The connector housing 130 has a card cavity 144 that opens to the mating face 132 (e.g., is accessed through the mating face 132). The card cavity 144 is sized and shaped to receive the leading edge 114 including the power modules 108. The card cavity 144 and the connector housing 130 extend lengthwise along the longitudinal axis 191. As shown, the card cavity 144 may include a signal region 264 and power regions 265, 266. The signal region 264 represents a portion of the card cavity 144 that has signal contacts (described below) exposed therein for engaging the signal contacts 122 along the leading edge 114 of the daughter card 106. The power regions 265, 266 represent portions of the card cavity 144 that have power contacts (described below) exposed therein for engaging the power contacts 124 along the leading edge 114.

In the illustrated embodiment, the signal region 264 is entirely located between the power regions 265, 266. For example, the power regions 265, 266 may be peripherally or laterally positioned with respect to the signal region 264 and may be proximate to the housing ends 136, 138, respectively. In such embodiments, the card cavity 144 may be configured to receive the daughter card 106 and, separately, a conventional type of daughter card, such as double data rate type three (DDR3) or double data rate type four (DDR4) formatted daughter cards. In particular embodiments, each and every one of the signal contacts along the signal region 264 is located between power contacts of the power regions 265, 266. In alternative embodiments, one or more power regions may separate or divide the signal region 264 into separate sub-regions.

In the illustrated embodiment, the receptacle connector 102 also includes card latches 150, 152. The card latches 150, 152 may be configured to move between open and closed positions. In FIG. 1, the card latches 150, 152 are in closed positions. For example, in some embodiments, the card latches 150, 152 are configured to rotate away from the daughter card 106 about a latch axis 194 that extends parallel to the lateral axis 193. The card latches 150, 152 include projections or grip elements 151, 153 that are sized and shaped to advance into the latch notches 119, 121 after the receptacle connector 102 and the daughter card assembly 104 are mated. Likewise, the card latches 150, 152 may be rotated again to remove the daughter card assembly 104.

In some embodiments, the power modules 108 are located proximate to the interconnecting edges 118, 120. For example, in particular embodiments, each and every one of the signals contacts 122 is located between the power modules 108. However, in other embodiments, the power modules 108 may be positioned at different locations. For example, a power module may be positioned between different sets of signal contacts 122.

Figure 2:
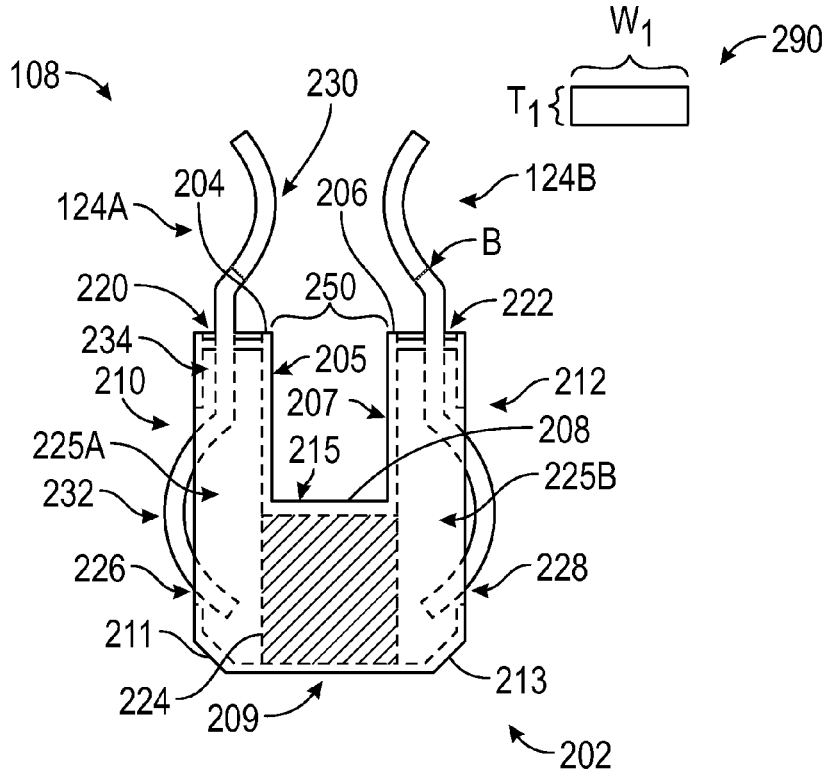
FIG. 2 is a side view of the power module that may be used with the daughter card assembly of FIG. 1.

FIG. 2 is a side view of an exemplary power module 108. The power module 108 includes a module housing 202 and first and second power contacts 124A, 124B. Although FIG. 2 shows two power contacts 124A, 124B, the power module 108 in other embodiments may include only one power contact or more than two power contacts. The module housing 202 may be shaped to interface with each of the first and second side surfaces 110, 112 (FIG. 1) along the leading edge 114 (FIG. 1). For example, the module housing 202 may include first and second housing arms 204, 206 that are joined by a housing joint 208. The housing arms 204, 206 may project from the housing joint 208 in a direction that is parallel to the mating axis 192 (FIG. 1) when the module housing 202 is coupled to the daughter card 106 (FIG. 1). The module housing 202 has module cavities 225A, 225B that are sized and shaped to receive the power contacts 124A, 124B, respectively. (Portions of the power contacts 124A, 124B within the module cavities 225A, 225B, respectively, are shown in phantom.) The housing arms 204, 206 may include the module cavities 225A, 225B, respectively.

The module housing 202 has exterior surfaces that may include a mating face 209 and lateral faces 210, 212. In the illustrated embodiment, the mating face 209 may extend generally parallel to a plane defined by the longitudinal and lateral axes 191, 193 (FIG. 1) and the lateral faces 210, 212 may extend generally parallel to a plane defined by the mating and longitudinal axes 192, 191. As shown, the lateral faces 210, 212 are joined to the mating face 209 by inclined surfaces 211, 213, respectively. The housing arms 204, 206 also include inner surfaces 205, 207, respectively, that face each other across a joint gap 250. The inner surfaces 205, 207 may be interconnected by a joint surface 215 of the housing joint 208. As described in greater detail below, the joint gap 250 may be sized and shaped to receive the leading edge 114 (FIG. 1) of the daughter card 106. Also shown, the housing arms 204, 206 include arm openings 220, 222, respectively, and side openings 226, 228, respectively. The arm and side openings 220, 226 provide access to the module cavity 225A, and the arm and side openings 222, 228 provide access to the module cavity 225B.

In the illustrated embodiment, the module cavities 225A, 225B are separate cavities in which each separate cavity holds the respective power contacts 124A, 124B. As shown, a partition or divider 224 may separate the module cavities 225A, 225B. However, in other embodiments, the module housing 202 may include a single continuous cavity that is sized and shaped to hold the power contacts 124A, 124B. Moreover, in some embodiments, the module cavities 225A, 225B may be configured to hold two or more power contacts. For example, two power contacts 124A can be positioned adjacent to each other in the module cavity 225A and two power contacts 124B can be positioned adjacent to each other in the module cavity 225B.

As described above, the power contact 124A is configured to transmit electrical power therethrough. In some embodiments, the power contacts 124A, 124B may have cross-sectional dimensions for carrying a higher amount of current than, for example, the signal contacts 122 (FIG. 1). More specifically, the cross-sectional dimensions of the power contacts 124A, 124B may be greater than the cross-sectional dimensions of the signal contacts 122. As used herein, "cross-sectional dimensions" are taken orthogonal to a flow of the current through the power contacts 124A, 124B. FIG. 2 illustrates a representative cross-section 290 of the power contact 124B taken at point B. The cross-sectional dimensions may include, for example, a thickness $T_1$ of the power contact 124B and a width $W_1$ of the power contact 124B. At least one of the thickness $T_1$ or width $W_1$ may be greater than the corresponding dimension of the signal contacts 122.

Although the following description is only in reference to the power contact 124A, the power contact 124B may have identical or similar features. As shown in FIG. 2, the power contact 124A may include a mounting segment 230, a mating segment 232, and a contact joint 234 that extends between and joins the mounting and mating segments 230, 232. The mounting segment 230 is configured to mechanically engage and electrically couple to a conductive surface, such as a contact pad 236 (shown in FIG. 3). The mounting segment 230 may be curved toward the contact pad 236. The mating segment 232 is configured to mechanically engage and electrically couple to an electrical contact of the receptacle connector 102 (FIG. 1).

In some embodiments, the module housing 202 may directly engage (e.g., grip) the power contacts 124A, 124B to hold the power contacts 124A, 124B in designated positions. For example, the module housing 202 may be shaped or molded to grip the contact joint 234. As shown in FIG. 2, the power contacts 124A, 124B are in unengaged or relaxed conditions. When the mating segments 232 are deflected into the corresponding module cavities 225A, 225B, the mating segments 232 may flex about the contact joints 234.

Figure 3:
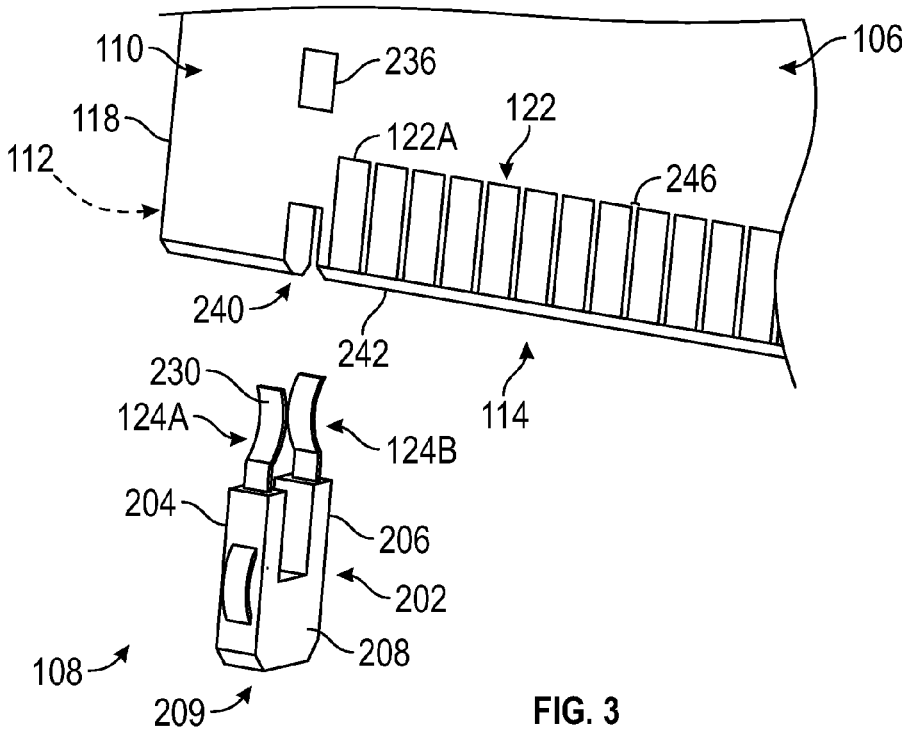
FIG. 3 is an enlarged exploded view of a daughter card and a power module that may be used with the daughter card assembly of FIG. 1.

FIG. 3 is an enlarged exploded view of the daughter card 106 and the power module 108. In some embodiments, the daughter card 106 includes a receiving notch 240 at the leading edge 114. The receiving notch 240 is sized and shaped to receive the module housing 202. For example, the receiving notch 240 may be dimensioned such that the mating face 209 is substantially flush with a distal surface 242 that defines the leading edge 114. In other embodiments, the mating face 209 may project beyond the distal surface 242 or, alternatively, be located a depth within the receiving notch 240. The receiving notch 240 may receive and cover at least a portion of the housing joint 208. The housing arms 204, 206 may extend along and interface with the side surfaces 110, 112, respectively. In some embodiments, the module housing 202 forms a frictional engagement (e.g., interference fit) with the daughter card 106 within the receiving notch 240. Alternatively or in addition to, the module housing 202 may be secured to the daughter card 106 using a fastener and/or adhesive.

The power contact 124A may engage the contact pad 236. In some embodiments, the engagement is made by soldering the mounting segment 230 to the contact pad 236 along the side surface 110. In other embodiments, the mounting segment 230 may be mechanically and electrically coupled to the contact pad 236 without soldering the mounting segment 230 thereto. For example, the mounting segment 230 may be pressed against the contact pad 236. As another example, the mounting segment 230 may include a press-fit contact or tail that is inserted into a plated thru hole or via through the side surface 110 and frictionally engages the thru hole. Like the power contact 124A, the power contact 124B may be mechanically and electrically engaged to a contact pad (not shown) or thru hole along the side surface 112.

Also shown in FIG. 3, the electrical contacts 122 may be contact pads that are distributed along the leading edge 114. Adjacent electrical contacts 122 may be separated from each other by a contact distance 246 that is measured along the longitudinal axis 191 (FIG. 1). In some embodiments, the contact pad 236 is located between the interconnecting edge 118 and an electrical contact 122A that is located at an end of a row of the electrical contacts 122.

Figure 4:
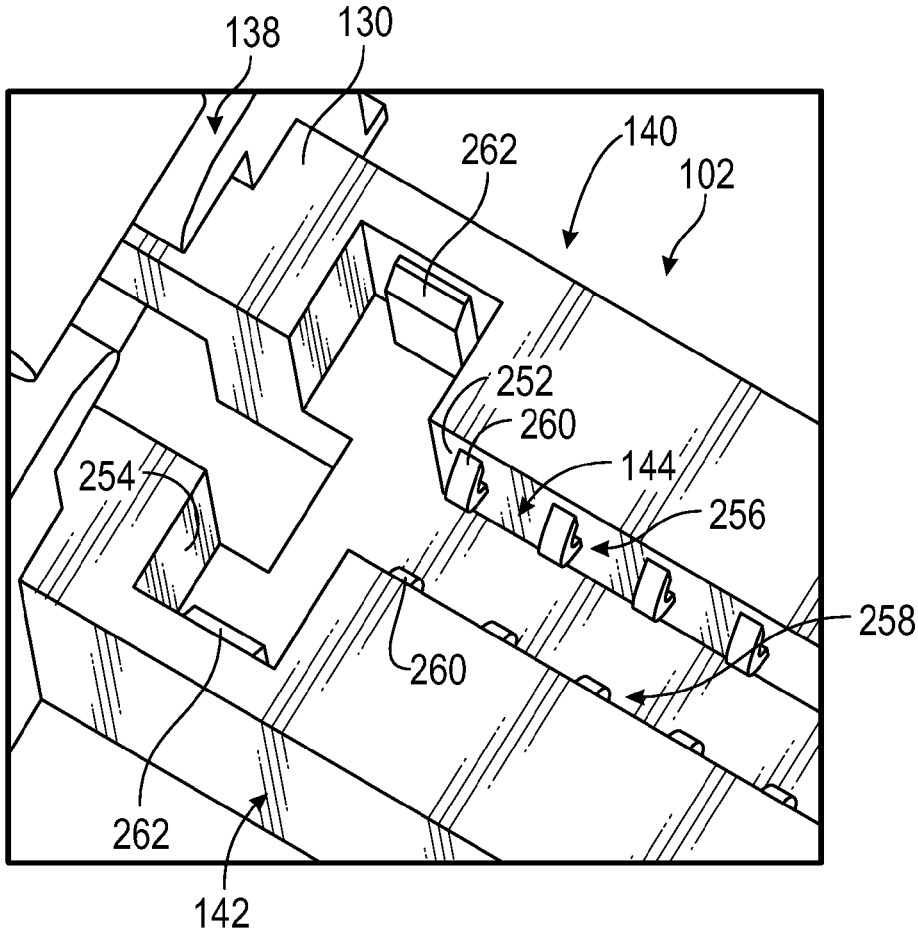
FIG. 4 is an enlarged isolated view of a portion of a receptacle connector of FIG. 1.
Figure 5:
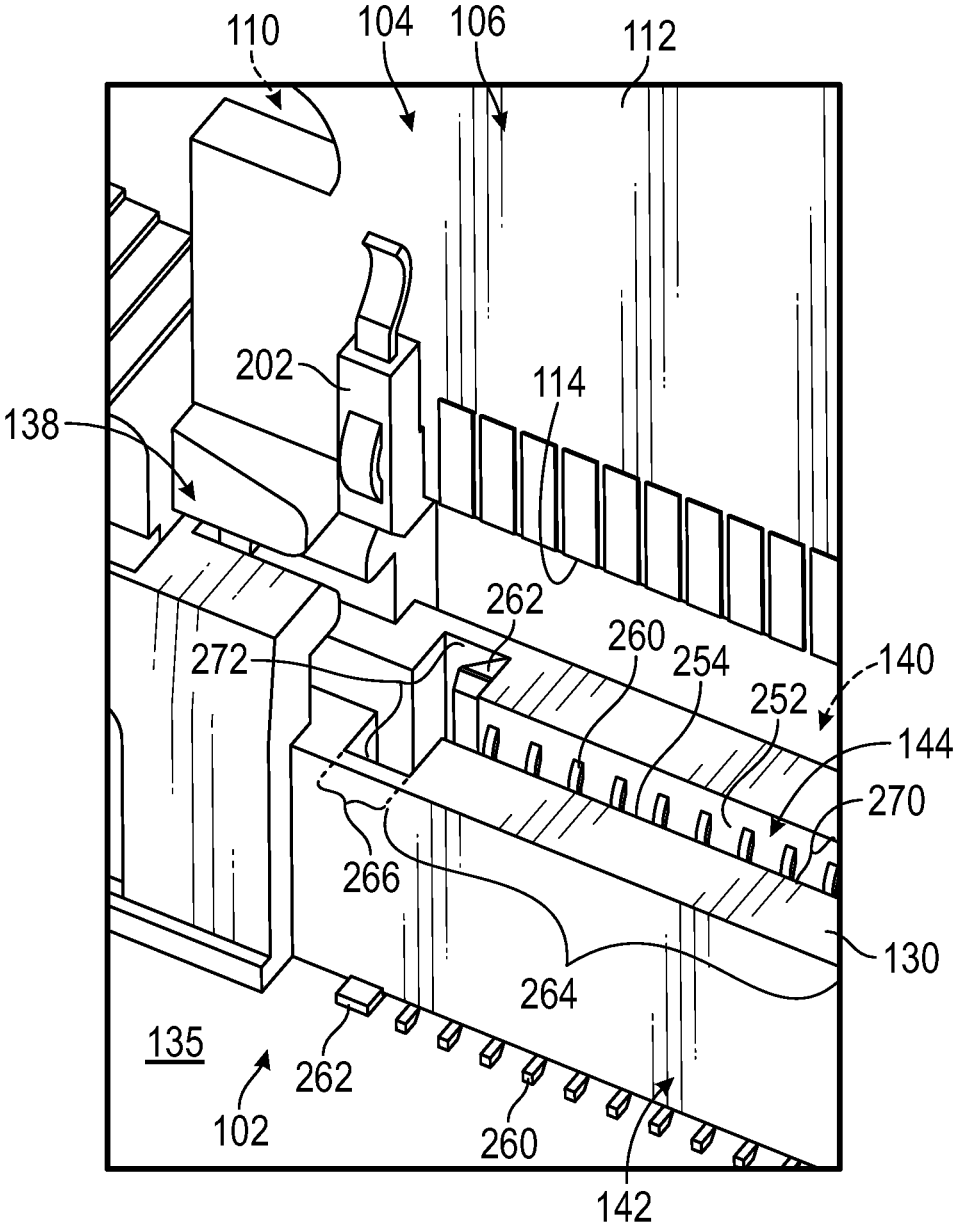
FIG. 5 is a perspective view of the receptacle connector and the daughter card assembly of FIG. 1 prior to mating.

FIG. 4 is an enlarged isolated view of a portion of the receptacle connector 102, and FIG. 5 is a perspective view of the receptacle connector 102 and the daughter card assembly 104 prior to mating. As shown, the connector housing 130 includes first and second interior walls 252, 254 that define the card cavity 144. The first and second interior walls 252, 254 oppose each other across the card cavity 144. The receptacle connector 102 includes electrical contacts 260 and 262 that are arranged along each of the interior walls 252, 254 and are exposed within the card cavity 144. (FIG. 5 shows tail portions of one of the electrical contacts 262 and a plurality of the electrical contacts 260 along the board surface 135.)

The electrical contacts 260 may be signal contacts and the electrical contacts 262 may be power contacts. More specifically, the card cavity 144 includes first and second rows 256, 258 (FIG. 4) of the signal contacts 260. The first and second rows 256, 258 may extend lengthwise along the card cavity 144 substantially between the housing ends 136 (FIG. 1), 138. The first and second rows 256, 258 of the signal contacts 260 oppose each other and are configured to engage the side surfaces 110, 112 (FIG. 5) of the daughter card 106 (FIG. 5). The card cavity 144 also includes the power contacts 262 exposed therein. In the illustrated embodiment, first and second power contacts 262 face each other across the card cavity 144. Similar to above, the signal contacts 260 and the power contacts 262 may have different cross-sectional dimensions configured to transmit data signals and electrical power, respectively.

With respect to FIG. 5, the card cavity 144 includes the signal region 264 and the power region 266. The signal and power regions 264, 266 may have different spatial dimensions. For instance, the signal region 264 may be dimensioned to receive the leading edge 114 of the daughter card 106 and the power region 266 may be dimensioned to receive the leading edge 114 of the daughter card 106 and the module housing 202 that is mounted to the daughter card 106 proximate to the leading edge 114. More specifically, the signal region 264 of the card cavity 144 may have a cavity width 270, and the power region 266 may have a cavity width 272. The cavity widths 270, 272 may be measured along the lateral axis 193 (FIG. 1). In the illustrated embodiment, the cavity width 272 is greater than the cavity width 270 in order to accommodate the size of the module housing 202. As such, the power contacts 262 and the signal contacts 260 may be located at different lateral depths. For example, the power contacts 262 may be closer to the housing side 140 (or the housing side 142) than the signal contacts 260. Accordingly, the power contacts 262 may be positioned further away from the daughter card 106 than the signal contacts 260 when the daughter card 106 is located within the card cavity 144.

Figure 6:
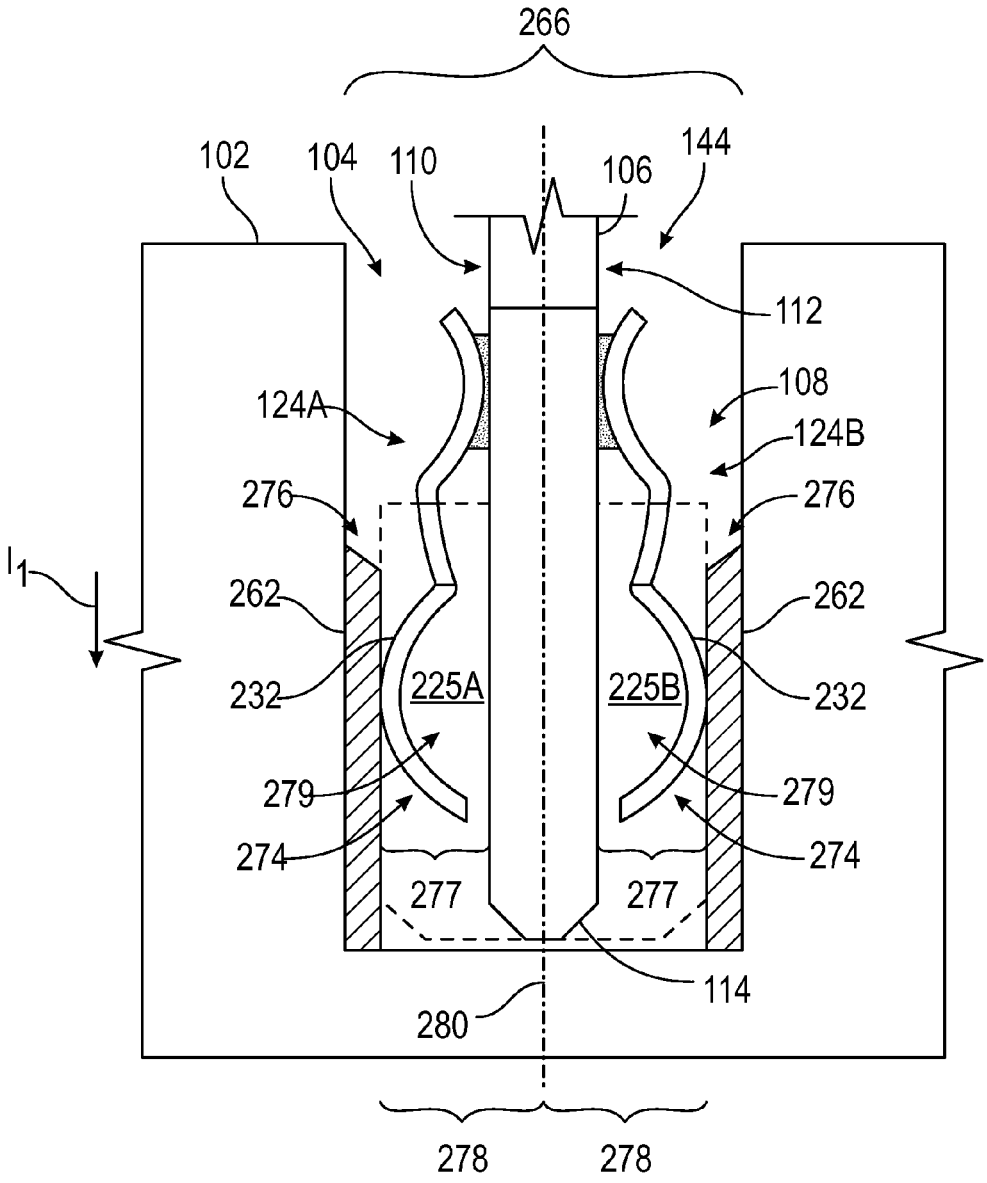
FIG. 6 is a side cross-section of the receptacle connector when the daughter card assembly and the receptacle connector of FIG. 1 are mated.
Figure 7:
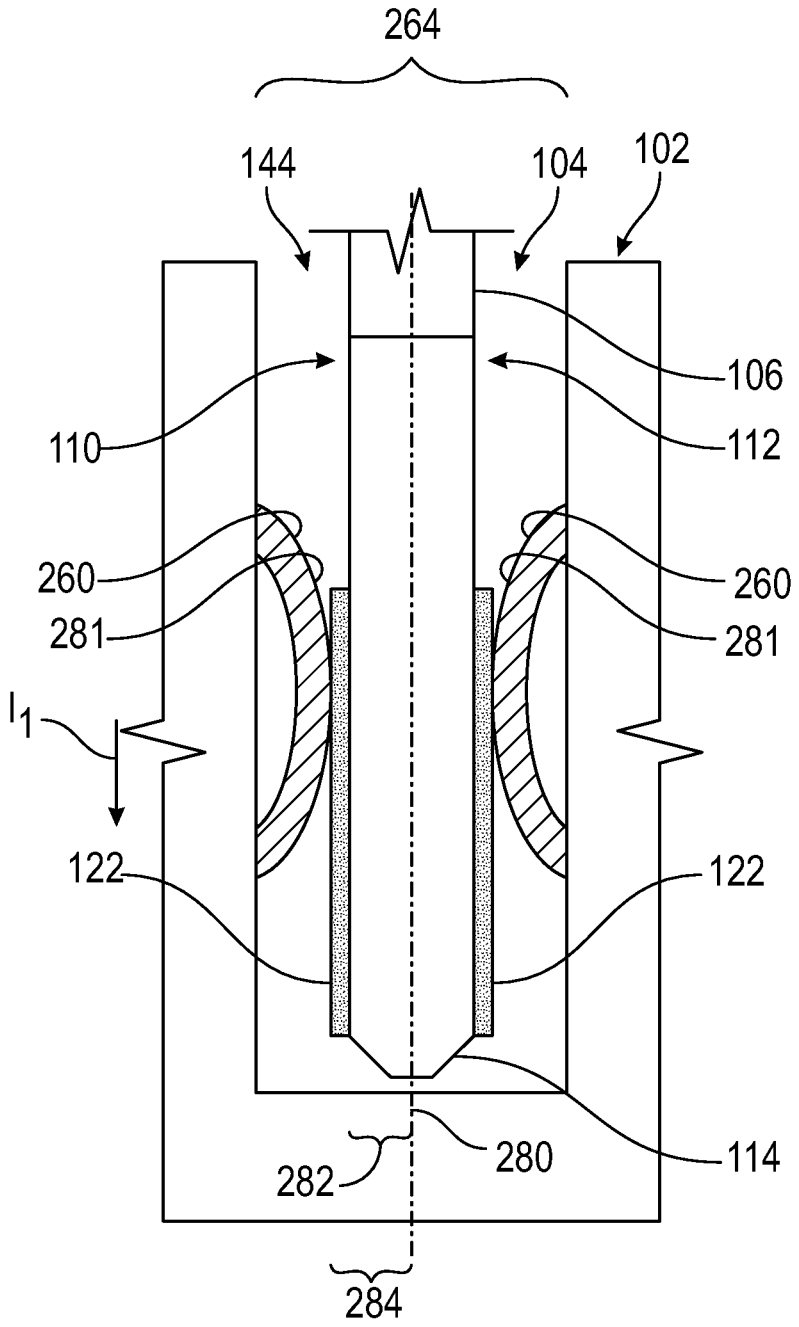
FIG. 7 is another side cross-section of the receptacle connector when the daughter card assembly and the receptacle connector of FIG. 1 are mated.

FIGS. 6 and 7 illustrate side cross-sections of the receptacle connector 102 at the power and signal regions 266, 264, respectively, when the daughter card assembly 104 and the receptacle connector 102 are mated. During the mating operation, the leading edge 114 of the daughter card assembly 104 is inserted into the card cavity 144 in an insertion direction $I_1$ along the mating axis 192 (FIG. 1). With respect to FIG. 6, the mating segments 232 of the power contacts 124A, 124B are shaped relative to the corresponding power contacts 262 such that, when the mating segments 232 engage the power contacts 262, the power contacts 124A, 124B are deflected toward the daughter card 106. The mating segments 232 may be deflected and moved into the respective module cavities 225A, 225B.

The mating segments 232 have wipe surfaces 274 that face away from the daughter card 106. The power contacts 262 of the receptacle connector 102 have wipe surfaces 276 that face the daughter card 106 when the daughter card 106 is located in the card cavity 144. Each of the wipe surfaces 276 is configured to directly engage a corresponding wipe surface 274 during the mating operation. As shown, a gap 279 may exist between each of the mating segments 232 and the respective side surface 110 or 112. The gap 279 is configured to reduce during the mating operation. Moreover, a separation distance 277 may exist between the wipe surfaces 276 and the respective side surfaces 110, 112.

Also shown in FIG. 6, the card cavity 144 may be divided by a central card plane 280. The card plane 280 may extend parallel to the longitudinal and mating axes 191, 192 (FIG. 1). In some embodiments, the card plane 280 may separate the power region 266 into substantially equal portions. As shown, after the daughter card 106 is mated with the receptacle connector 102, the daughter card 106 coincides with the card plane 280. The wipe surfaces 276 may be located a center spacing or distance 278 away from the card plane 280.

Turning to FIG. 7, the signal region 264 of the card cavity 144 is also divided by the card plane 280. As shown, the signal contacts 122 may be substantially flush with the respective side surfaces 110, 112 of the daughter card 106. For example, the signal contacts 122 may be contact pads. However, the signal contacts 260 may be flexible beams having wipe surfaces 281 that face the daughter card 106 and directly engage the electrical contacts 122. More specifically, as the leading edge 114 of the daughter card assembly 104 is inserted into the card cavity 144 in the insertion direction $I_1$, the leading edge 114 may directly engage and deflect the signal contacts 260 away from the card plane 280. The wipe surfaces 281 of the signal contacts 260 may be configured to slide along the side surfaces 110, 112, respectively, and directly engage the signal contacts 122. Unlike the power contacts 262 shown in FIG. 6, the signal contacts 260 may be pressed against the daughter card 106 such that no separation distance exists therebetween. Before mating, the wipe surfaces 281 may be located a center distance 282 away from the card plane 280. After mating, the wipe surfaces 281 may be located a center distance 284 away from the card plane 280. As shown, the center distance 282 is less than the center distance 284. However, the center distance 284 is less than the center distance 278 (FIG. 6).

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description and the figures are intended to be illustrative, and not restrictive. For example, the above-described and/or illustrated embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components (including the terms "upper", "lower", "vertical", and "lateral"), and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description and the figures. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A daughter card assembly comprising:

a daughter card having a leading edge extending along a longitudinal axis, the daughter card including signal contacts that are disposed along the leading edge, wherein the leading edge is configured to be inserted into a card cavity of a receptacle connector during a mating operation when the leading edge is moved in an insertion direction that is substantially perpendicular to the longitudinal axis; and a power module coupled to the daughter card proximate to the leading edge, the power module including a module housing having a module cavity and a cavity opening that provides access to the module cavity, the power module also including a power contact that is disposed within the module cavity and projects through the cavity opening, wherein the power contact is configured to engage a corresponding electrical contact of the receptacle connector during the mating operation, the power contact being deflected by the electrical contact into the module cavity as the power contact and the electrical contact engage each other.

2. The daughter card assembly of claim 1, wherein the daughter card includes a receiving notch along the leading edge, the receiving notch being sized and shaped to receive the module housing.

3. The daughter card assembly of claim 1, wherein the power contact includes a mating segment, a mounting segment, and a contact joint that joins the mating and mounting segments, the mounting segment being mechanically and electrically coupled to the daughter card, the mating segment configured to flex about the contact joint when the power contact is deflected by the electrical contact.

4. The daughter card assembly of claim 1, wherein the signal contacts and the power contact have different cross-sectional dimensions, the cross-sectional dimensions of the power contact being greater than the cross-sectional dimensions of the signal contacts to transmit electrical power.

5. The daughter card assembly of claim 1, wherein the signal contacts are substantially flush with a side surface of the daughter card, the power contact extending away from the side surface, the power contact having a mating segment that is located a distance away from the side surface such that a gap exists between the mating segment and the side surface.

6. The daughter card assembly of claim 1, wherein the daughter card has opposite first and second side surfaces, the module housing shaped to interface with each of the first and second side surfaces along the leading edge.

7. The daughter card assembly of claim 6, wherein the module housing includes a housing joint and first and second housing arms that project substantially parallel to each other from the housing joint, the first and second housing arms being separated by a joint gap that is sized and shaped to receive the daughter card.

8. The daughter card assembly of claim 6, wherein the power contact is a first power contact and the power module includes a second power contact, the first power contact being mechanically and electrically coupled to the first side surface and the second power contact being mechanically and electrically coupled to the second side surface.

9. A receptacle connector comprising:

a connector housing having opposite mating and loading faces and a mating axis extending therebetween, the connector housing having a card cavity that is accessed through the mating face and an interior wall that extends along the mating axis defining the card cavity, the connector housing and the card cavity extending lengthwise along a longitudinal axis that is perpendicular to the mating axis;

signal contacts arranged along the interior wall and exposed to the card cavity; and a power contact disposed within the card cavity, the signal contacts and the power contact having different cross-sectional dimensions;

wherein the power contact and the signal contacts have respective wipe surfaces that engage corresponding electrical contacts of a daughter card during a mating operation, the daughter card coinciding with a central card plane when the daughter card and the receptacle connector are mated, the wipe surface of the power contact being a first center distance away from the card plane, the wipe surfaces of the signal contacts being a second center distance away from the card plane, the first center distance being greater than the second center distance.

10. The receptacle connector of claim 9, wherein the interior wall is a first interior wall and the connector housing includes a second interior wall that faces the first interior wall, the signal contacts forming first and second rows of signal contacts arranged along the first and second interior walls, respectively.

11. The receptacle connector of claim 9, wherein the interior wall is a first interior wall and the connector housing includes a second interior wall that faces the first interior wall, the power contact being a first power contact and the receptacle connector including a second power contact, the first and second power contacts being disposed proximate to the first and second interior walls, respectively, such that the daughter card is located between the first and second power contacts when the daughter card and the receptacle connector are mated.

12. The receptacle connector of claim 9, wherein the interior wall is a first interior wall and the connector housing includes a second interior wall that faces the first interior wall, the card cavity being defined between the first and second interior walls and including a signal region and a power region, wherein the signal and power regions having different spatial dimensions such that the signal region is dimensioned to receive a leading edge of the daughter card and the power region is dimensioned to receive the leading edge of the daughter card and a module housing that is mounted to the daughter card proximate to the leading edge.

13. The receptacle connector of claim 9, wherein the interior wall is a first interior wall and the connector housing includes a second interior wall that faces the first interior wall, the card cavity being defined between the first and second interior walls and including a signal region and a power region, wherein the first and second interior walls are separated by a first cavity width along the power region of the card cavity and the first and second interior walls are separated by a second cavity width along the signal region, the first cavity width being greater than the second cavity width, the signal contacts arranged within the signal region and the power contact disposed within the power region.

14. The receptacle connector of claim 9, wherein the interior wall is a first interior wall and the connector housing includes a second interior wall that faces the first interior wall, the card cavity being defined between the first and second interior walls and including a signal region and a power region, the connector housing extending along the longitudinal axis between two housing ends, the power region being located between one of the housing ends and the signal region.

15. The receptacle connector of claim 9, wherein the receptacle connector includes a pair of the power contacts, the signal contacts fanning a row of signal contacts along the interior wall, each and every one of the signal contacts in said row being located between the pair of the power contacts.

16. The receptacle connector of claim 9, wherein the signal contacts are configured to be deflected by the daughter card.

17. A communication system comprising:

a receptacle connector comprising a connector housing having opposite mating and loading faces and a mating axis extending therebetween, the connector housing having a card cavity that is accessed through the mating face, the receptacle connector including signal contacts and a power contact disposed within the card cavity; and a daughter card assembly configured to mate with the receptacle connector, the daughter card assembly comprising:

a daughter card having a leading edge extending along a longitudinal axis, the daughter card including first electrical contacts that are disposed along the leading edge; and a power module coupled to the daughter card proximate to the leading edge, the power module including a module housing having a module cavity and a cavity opening that provides access to the module cavity, the power module also including a second electrical contact that is disposed within the module cavity and projects through the cavity opening;

wherein the signal contacts of the receptacle connector engage the first electrical contacts of the daughter card during a mating operation and the power contact of the receptacle connector engages the second electrical contact of the daughter card during the mating operation, the second electrical contact being deflected toward the daughter card by the power contact as the second electrical contact and the power contact engage each other.

18. The communication system of claim 17, wherein the power contact and the signal contacts of the receptacle connector have wipe surfaces that engage the second electrical contact and the first electrical contacts, respectively, the daughter card coinciding with a central card plane when the daughter card assembly and the receptacle connector are mated, the wipe surface of the power contact being a first center distance away from the card plane, the wipe surfaces of the signal contacts being a second center distance away from the card plane, the first center distance being greater than the second center distance.

19. The communication system of claim 17, wherein the daughter card has opposite first and second side surfaces, the module housing shaped to interface with each of the first and second side surfaces along the leading edge.

20. The communication system of claim 17, wherein the daughter card includes a receiving notch along the leading edge, the receiving notch being sized and shaped to receive the module housing.

* * * * *